United States Patent [19]

Zeppellini

[11] 4,121,651

[45] Oct. 24, 1978

[54] CASTING RECEPTACLE OR LADLE FOR MOULDED CASTINGS OR VARIOUS MATERIALS

[76] Inventor: Dino Marco Zeppellini, 2 Ave. F.-Roosevelt, Fontenay-sous-Bois, France, 94120

[21] Appl. No.: 790,794

[22] Filed: Apr. 25, 1977

[30] Foreign Application Priority Data

May 10, 1976 [FR] France ..... 76 13963

[51] Int. Cl.[2] ..... B22D 37/00

[52] U.S. Cl. ..... 164/337

[58] Field of Search ..... 164/335, 337

[56] References Cited

U.S. PATENT DOCUMENTS

| | | | |
|---|---|---|---|
| 3,206,301 | 9/1965 | Daubersy | 164/337 X |
| 3,352,351 | 11/1967 | Sickbert | 164/335 |
| 3,655,176 | 4/1972 | Winkler et al. | 164/337 X |
| 3,749,387 | 7/1973 | Andrzejak et al. | 164/337 X |

*Primary Examiner*—Robert L. Spicer, Jr.

*Attorney, Agent, or Firm*—William Anthony Drucker

[57] ABSTRACT

A casting device comprising a receptacle having an exit orifice at its lower end, a tubular stem carrying a valve for sealing the orifice, a rod in the stem and a valve member carried by the rod for opening and closing the bottom end of an annular space formed between the rod and the stem.

5 Claims, 2 Drawing Figures

CASTING RECEPTACLE OR LADLE FOR MOULDED CASTINGS OR VARIOUS MATERIALS

BACKGROUND OF THE INVENTION

1. Field of the Invention

The present invention relates to a casting apparatus designed to feed liquid to moulds intended for the manufacture of castings of mechanical parts or decorative articles, suitable for any industry, the castings being moulded from a material in a liquid state.

2. Description of the Prior Art

When metal has to be cast in a molten state, the foundryman is constantly faced with the problem of how to obtain sound castings free from blow holes, slag and pipes, and these casting troubles are mainly due to the oxidation of the surface of the metal in contact with the air, which makes it easier for slag to form, which enters the mould during the normal casting process, owing to the gradual inversion of the casting crucible or receptacle.

In order to remedy this drawback, casting crucibles have been designed which can be filled from the bottom, by immersion in the maintenance furnace, but the oxidation continues to occur at the moment of casting.

An object of the invention is to enable an inert gas to be fed to the mould prior to the casting operation.

SUMMARY OF THE INVENTION

According to the invention I provide a casting device comprising a receptacle having an exit orifice at its lower end, a hollow stem arranged in said receptacle with its lower end closably fitting said exit orifice, a rod within said stem, said rod being of smaller diameter than the internal diameter of the stem so as to leave an annular space between the rod and the stem, a valve member on the lower end of the rod adapted to close the lower end of the stem, means acting on the rod to move it axially in relation to the stem to cause the valve member to open and close the lower end of the stem, and means at the upper part of said stem for the supply of inert gas under pressure to said annular space.

A further object of the invention is to enable contact between the liquid metal and the air at the moment of casting to be avoided altogether, by causing the bottom of the crucible to bear direct, with a tight joint, on the feed orifice of the mould. This close contact between the mould and the crucible considerably reduces the volume of the riser and thus the cost of the moulded article.

A further advantage at which the invention is aimed resides in the fact that it makes it possible to introduce metal into a rotating mould because of the presence of a rotating hermetic joint.

A further purpose of the invention is to enable moulding to be carried out at low pressure, feeding one or more similar moulds either in succession or in one single casting operation, owing to the fact that the crucible can be given the shape and dimensions required by the mould.

The invention also provides for the admission of gaseous fluid (preferably inert) at a controlled pressure above the free surface of the liquid, so that moulding can be effected under pressure.

Finally, the invention makes it possible to mould at low or high pressure or by centrifuging either the mould alone or the mould and the ladle.

DESCRIPTION OF THE PREFERRED EMBODIMENTS

Figure 1:
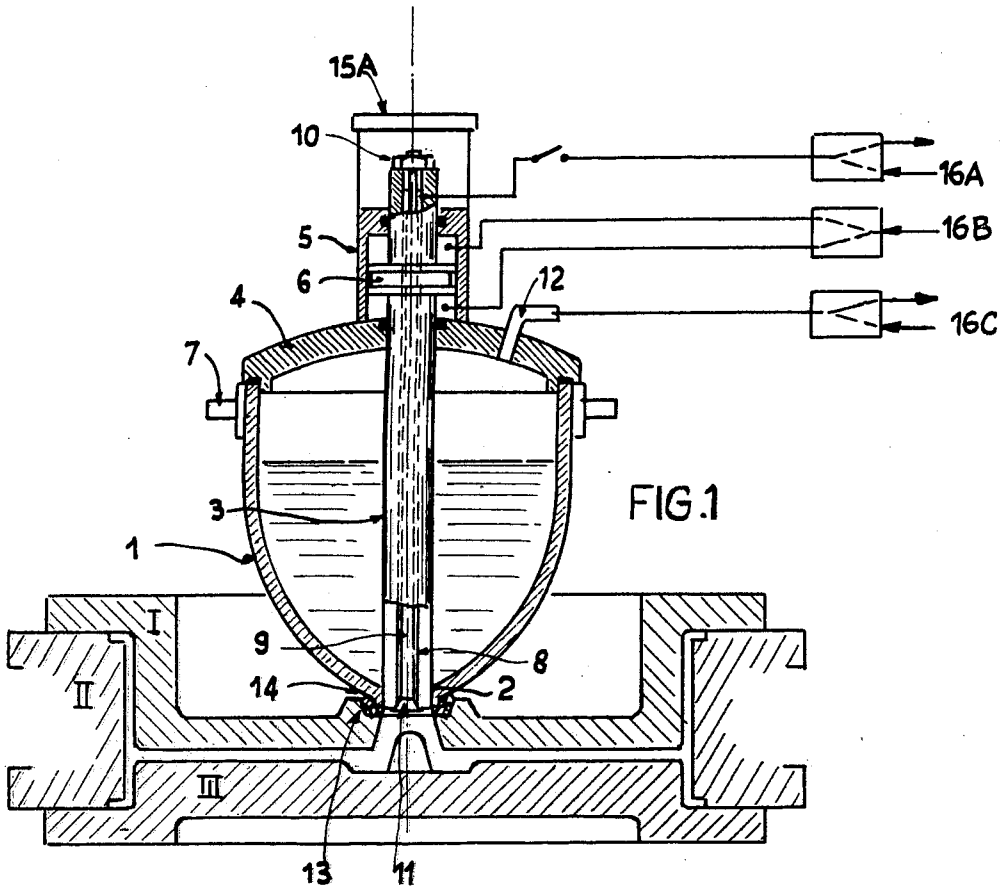
FIG. 1 is a sectional diagram, part of the exterior having been removed, of a casting crucible secured against rotation and feeding a mould which is either secured or rotating.

The casting crucible 1 shown in FIG. 1 is provided at the bottom with a cylindrical bore 2 which can be obstructed by the lower end of a stem 3 which is movable in a vertical direction and which is indirectly supported by a cover 4 of which the upper part comprises a cylinder 5, a piston 6 integral with the stem 3 and movable in the said cylinder. According to the volume of the crucible, supporting devices, such as trunnions 7, may be provided, these being connected to an automatic handling device, as well as any suitable means enabling the crucible to perform a translatory movement while at the same time enabling it to rotate about its vertical axis. The cylinder 5 carries a removable cover 15A.

The stem 3 has a bore 8 therein which can be hermetically sealed at the bottom, when desired, by operating a device such as a rod 9 having a valve 11 at its lower end which seats in the lower end of the stem and is held on its seat or removable therefrom by any suitable means, such as the nut 10 shown in the drawing.

The bore 8 is slightly greater than the diameter of the rod 9, in such a way as to leave a free passage, in the bore 8, for an inert gas, at slight pressure, enabling it to escape from the stem 3 when the rod 9 is moved to displace the valve 11 from its seating.

The displacement of the stem 3 parallel to its axis can be effected mechanically or, as shown, by acting on the upper or lower face of the piston 6, which is integral with the stem, by the admission of a fluid under pressure (air or liquid); the ascending movement enables the lower end of the stem 3 to move away from the bore 2, thus giving free passage to the metal or other liquid, either in order to fill the crucible in the course of its immersion in the maintenance furnace or in order to fill the mould; the descending movement enables the base of the crucible to be sealed up during the maintenance operation.

When casting is being carried out under pressure a compressed gas acting on the free surface of the metal, for example, can be introduced into the crucible by an inlet 12 provided in the cover.

The upper part I of the mould I-II-III has a standard recess 13 intended to accommodate a joint 14 and providing the required hermetic closure between the bottom of the crucible, from which the liquid will emerge, and the feed aperture of the mould.

When a moulding operation is being effected under the pressure of the gas arriving through the inlet 12, a jack 15 (FIG. 2) which controls the various movements of the crucible can exert on the latter a certain external pressure in order to maintain the hermetic sealing of the joint 14, which is designed in such a way as to enable the casting operation to be carried out in a rotating mould fed by a fixed crucible.

An automatic compressed air distributor 16B controls the displacement of the stem 3 in both directions, parallel to its axis, via the piston 6 moving in the cylinder 5.

Devices 16A and 16C, acting on the principle of alternating complete admission and complete shut-off, and at controlled pressures, make it possible, respectively, to introduce an inert gas into the bore 8, the valve 11 having been detached from its seating, or to introduce the same inert gas above the ladle, by the inlet 12.

Figure 2:
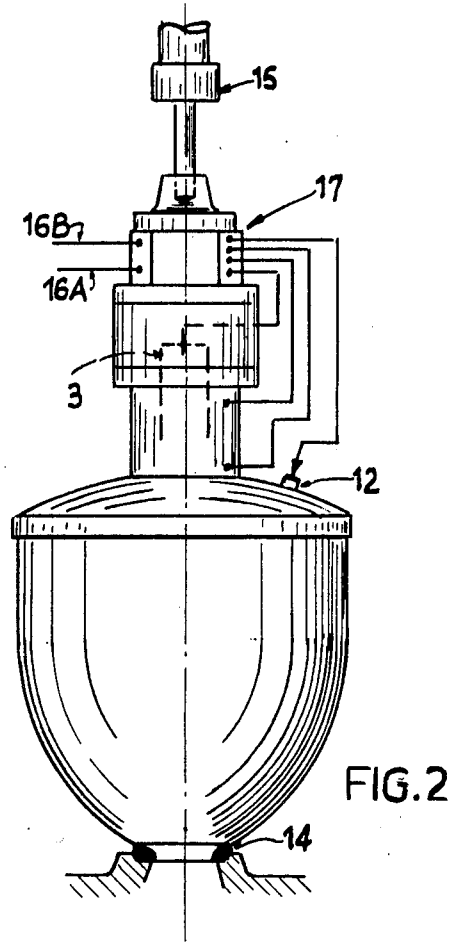
FIG. 2 is a diagram in elevation of a crucible so constructed that it can rotate about its vertical axis at the same time as the mould.

The casting crucible shown in FIG. 2 is a variant of that shown in FIG. 1. It only differs from the latter in that it is provided with a rotary combination fluid pressure distributor 17 which enables the same handling operation to be effected as described previously but by causing the crucible and the mould to perform one and the same rotation in the course of the casting process.

If necessary, the moulding temperature can be maintained in the crucible by a suitable external or internal heating means.

I claim:

1. A casting device comprising:

(a) a receptacle having an exit orifice at its lower end;

(b) a hollow stem arranged in said receptacle with its lower end closably fitting said exit orifice;

(c) a rod within said stem, said rod being of smaller diameter than the internal diameter of the stem so as to leave an annular space between the rod and the stem;

(d) a valve member on the lower end of the rod adapted to close the lower end of the stem;

(e) means acting on the rod to move it axially in relation to the stem to cause the valve member to open and close the lower end of the stem; and (f) gas inlet means at the upper part of said stem for the supply of inert gas under pressure to said annular space.

2. A casting device according to claim 1, including a sealing member surrounding the exit orifice for making a sealing engagement with a mould entry aperture, said sealing member being so constructed as to permit rotation of the mould.

3. A casting device according to claim 1, having a cover closing the upper part of the receptacle, a cylinder mounted on said cover, a piston slidable in said cylinder connected to said stem and means for introducing fluid pressure to the cylinder on opposite sides of the piston alternately.

4. A casting device according to claim 1, having means for supplying fluid pressure to the receptacle from a source external to said receptacle.

5. A casting device according to claim 1, having a fluid pressure distributor controlled by rotation of the receptacle and having means to supply fluid under pressure to said distributor and means for supplying said fluid pressure from the distributor to said annular space, to said cylinder, and to said receptacle.

* * * * *